US007216935B2

(12) United States Patent
Wegener

(10) Patent No.: US 7,216,935 B2
(45) Date of Patent: May 15, 2007

(54) DYNAMIC CHAIR

(76) Inventor: William E. Wegener, 298 Casitas Bulevar, Los Gatos, CA (US) 95032

( * ) Notice: Subject to any disclaimer, the term of this patent is extended or adjusted under 35 U.S.C. 154(b) by 0 days.

(21) Appl. No.: 11/333,948

(22) Filed: Jan. 17, 2006

(65) Prior Publication Data

US 2006/0138834 A1 Jun. 29, 2006

Related U.S. Application Data

(63) Continuation of application No. 11/088,011, filed on Mar. 22, 2005, now Pat. No. 7,008,017.

(60) Provisional application No. 60/581,099, filed on Jun. 17, 2004.

(51) Int. Cl.
*A47C 3/00* (2006.01)

(52) U.S. Cl. ..... 297/330; 297/314

(58) Field of Classification Search ..... 297/217.1, 297/217.3, 313, 314, 330, 337
See application file for complete search history.

(56) References Cited

U.S. PATENT DOCUMENTS 4,650,247 A * 3/1987 Berg et al. ..... 297/284.1
5,088,473 A * 2/1992 Chen et al. ..... 601/26
5,113,851 A * 5/1992 Gamba ..... 297/330
5,588,704 A * 12/1996 Harza ..... 297/314
5,735,575 A * 4/1998 Harza ..... 297/314
5,976,097 A * 11/1999 Jensen ..... 297/330
6,033,021 A * 3/2000 Udo et al. ..... 297/313
6,139,095 A * 10/2000 Robertshaw ..... 297/105
6,412,867 B2 * 7/2002 Robinson ..... 297/260.2
6,644,745 B2 * 11/2003 Rogers et al. ..... 297/344.2
2002/0027384 A1 * 3/2002 Zur ..... 297/452.41
2004/0035347 A1 * 2/2004 Grober ..... 114/191

* cited by examiner

*Primary Examiner*—Peter R. Brown
(74) *Attorney, Agent, or Firm*—Sierra Patent Group, Ltd.

(57) ABSTRACT

The present invention provides a dynamic chair having a deterministic motion path that allows a variety to different paths to be selected depending of needs of user. By changing the ratio between drive wheels that control the pitch and roll of the seat, motion paths can be selected to help a person assume and/or avoid certain postures while seated. Embodiments of the present invention move the seat of the dynamic chair through a deterministic path to dictate how often and when the seat is in a level position with respect to pitch and roll.

1 Claim, 15 Drawing Sheets

DYNAMIC CHAIR

RELATED APPLICATION

This application is a continuation of co-pending U.S. patent application Ser. No. 11/088,011, filed Mar. 22, 2005, which claims priority to U.S. provisional patent Ser. No. 60/581,099, filed Jun. 17, 2004, both of which are incorporated herein by reference in their entirety.

FIELD

The present invention relates broadly to chairs having powered motion. Specifically, the present invention relates to a chair seat that travels through a preferred range of motion to distribute pressure over a large area beneath a seated person.

BACKGROUND

In a seated position, a very small area under the buttocks supports the majority of a person's weight. In this small area, capillaries and soft tissue are compressed. Blood circulation is restricted and soft tissue is put under stress. Prolonged sitting over time can damage the tissue being compressed. The simple solution is to avoid sitting for prolonged periods, but such a solution is not realistic for many people who must sit for prolonged periods to perform many necessary functions such as driving or working.

Two major factors that contribute to the physical detriments described above are time and compressive pressure. Reducing one or both of these factors reduces the stress on the soft tissue. If the compressive pressure under the buttocks is shifted back and forth between two locations, then the duration of compressive pressure experienced at one position is reduced by half. This would allow some measure of periodical relief of the pressure points. If the compressive pressure point could be rotated between several positions over time, then the time of tissue stress at each position can be further reduced. As the number of pressure points is increased, the period of stress is reduced at each pressure point. In order to obtain the maximum number useful pressure points, the pressure points need to be evenly distributed over the entire buttocks area.

One solution to this problem is a seat that tilts in two dimensions with a pivot that is located under the center of the seat. Such a seat can continuously rotate in a circular manner, thus distributing pressure over a large number of pressure points, as shown in the motion path illustrated in FIG. 1. The problem with this method is that all pressure points are limited to only one circular path under the buttocks area. This simple motion path misses the majority of possible pressure point locations.

U.S. Pat. No. 5,976,097 to Jensen and U.S. Pat. No. 5,113,851 to Gamba both disclose a chair having a seat that is permanently tilted at a fixed angle with respect to the center of the seat. The chair seat is motor-driven to rotate this tilted fixed angle in a circular manner with respect to the center of the seat. It is important to point out that the seat does not rotate. It is the seat's tilting fixed angle that rotates around the center of the seat. The direction of this circular tilting motion remains constant and the circular tilt pattern repeats identically on each rotation. Since the seat is always tilted, the seat needs to be always in motion or a seated person will be sitting in a twisted fashion, trying to compensate for the static, tilted nature of the chair. While the purpose of the chairs described in Jensen and Gamba is to prevent sitting in a static position and thus holding the same posture for prolonged period of time, sitting in these chairs requires continuous posture adjustments. FIG. 1 illustrates a graphical plot of the circular tilted motion generated by the chairs described in Jensen and Gamba. At location 1, seat 10 is tilted backwards only, as shown in FIGS. 2A and 2B. At location 2 of FIG. 1, seat 10 is tilted to the right side only, as shown in FIGS. 3A and 3B. At location 3 of FIG. 1, seat 10 is tilted to the right and tilted forward, as illustrated in FIGS. 4A and 4B. At location 4 of FIG. 1, seat 10 is tilted forward only, as shown in FIGS. 5A and 5B. For seat 10 to be level, as shown in FIGS. 6A and 6B, seat 10 travels through a path taking it through location 5 of FIG. 1. But because the seats of Jensen and Gamba rotate at a fixed angle, they never pass through this horizontal position.

While Jensen and Gamba both address part of the problem described above, and it is desirable for a seated person to change posture and not sit in a static position for extended periods of time, it is not desirable to be forced to make continuous postural changes while seated over prolonged periods of time. Due to the fixed angle of the chairs described in Jensen and Gamba and their inability to ever become level, these seats always need to be moving, thus requiring constant posture changes for a seated person, and the seat cannot be used as a regular level chair. Also, neither Jensen nor Gamba disclose or suggest any manner in which the seat can be easily stopped, or how the seat can be stopped periodically.

U.S. Pat. No. 6,033,021 to Udo discloses a self-tilting seat that utilizes two independent, unsynchronized tilting mechanisms to generate a path from two separate motors. There is no disclosure in Udo for detecting a level position. If a level position of the seat is ever reached it is achieved randomly, and not in a repeatable manner, as the two independent tilting mechanisms are not synchronized. There is a heartfelt need for a dynamic chair having a repeatable and deterministic motion path to generate a known range of postural changes to alleviate compressive pressure at as many pressure points as possible.

SUMMARY OF THE INVENTION

The present invention provides a dynamic chair having a deterministic motion path that allows a variety to different paths to be selected depending of needs of user. By changing the ratio between drive wheels that control the pitch and roll of the seat, motion paths can be selected to help a person assume and/or avoid certain postures while seated. Embodiments of the present invention move the seat of the dynamic chair through a deterministic path to dictate how often and when the seat is in a level position with respect to pitch and roll.

The present invention provides a dynamic chair providing automatic motion in a seat. The chair includes a base, a seat having a bottom, the seat bottom having first and second mounting points on the bottom of the seat, a support disposed between the base and the seat bottom, and a drive motor. A first drive wheel is driven in a rotational manner by the drive motor, and has a first mounting point offset from the center of the first drive wheel. A first control provides a first rotational degree of freedom of movement to the seat, and is attached between the first offset mounting point and the first seat bottom mounting point. A second drive wheel is driven in a rotational manner by the first drive wheel. A crankshaft has one end connected to the second drive wheel and is rotatably driven by the second drive wheel, and the second end has an eccentric providing a second offset mounting point offset from the center of the second crankshaft end. A second control provides a second rotational degree of freedom of movement to the seat, and is attached between the second offset mounting point and the second seat bottom mounting point. The first drive wheel and the second drive wheel are configured in a nonequal ratio of diameters within a range of 20.0:1.0 and 1.0:20.0, such that a changing, substantially ellipsoidal pattern of movement is produced in the seat bottom.

In an embodiment, the first seat bottom mounting point is offset 90 degrees from the second seat bottom mounting point with respect to the location of the support. The first offset point is disposed at a first distance from a center of rotation of the first eccentric for the seat and the second offset point has a second distance from the center of rotation of the second eccentric for the seat. The first distance determines a range of rotation of the seat's first rotational degree of freedom, and the second distance determines a range of rotation of the seat's second rotational degree of freedom. The first and second ranges of rotation are within −5 degrees to +5 degrees.

In an embodiment, the support incorporates a universal joint and an attached extension arm, and the seat bottom is attached to the extension arm and the base is attached to the universal joint. The support provides a first degree of linear freedom of linear movement for the seat and a second degree of linear freedom of linear motion for the seat, with the first degree of freedom of linear motion orthogonal to the second degree of freedom of linear movement. The length of the extension arm determines a radial distance from the universal joint to the seat, so that as the universal joint rotates, the radial distance and a rotational angle of the universal joint determine a first linear travel distance for the first degree of freedom of linear motion and a second linear travel distance for the second degree of freedom of linear motion.

In an embodiment, the first control and the second control are connected to the first seat mounting point and the second seat mounting point, respectively, such that the seat is moved through the changing, substantially ellipsoidal pattern of movement, such as a Lissajou pattern.

In various embodiments, the dynamic chair of the present invention can include a motor speed controller that controls the rotational speed of the first drive wheel, a motor timer that provides periodic motor stop time, and a plurality of level sensors that indicate that the seat is level with respect to pitch and roll so that the chair motion can be temporarily halted when the seat is level.

Many other features and advantages of the present invention will be realized upon reading the following detailed description, when considered in conjunction with the accompanying drawings.

BRIEF DECRIPTION OF THE DRAWINGS

DETAILED DESCRIPTION

Figure 9:
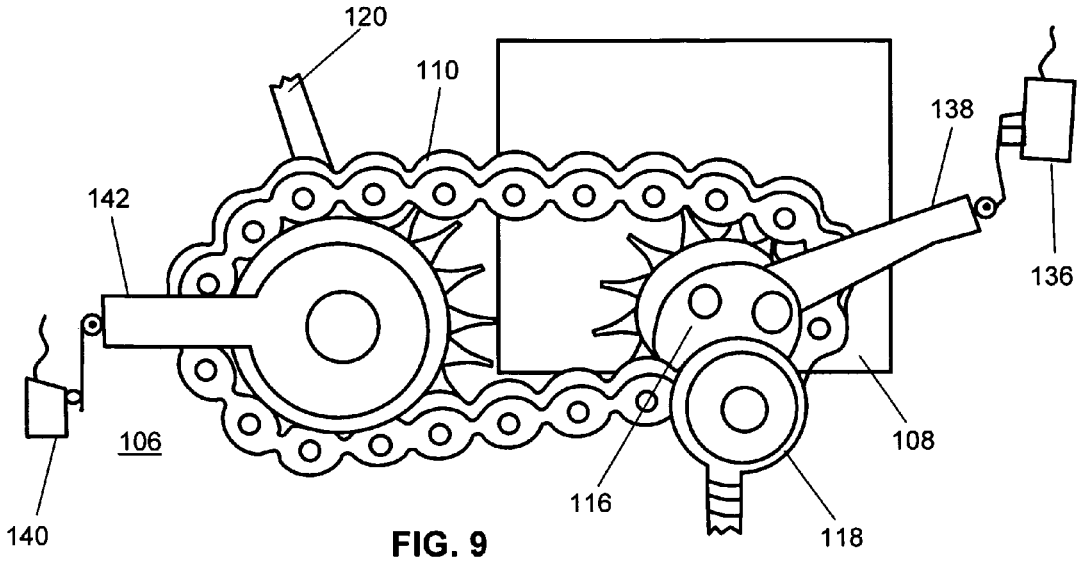
FIG. 9 illustrates the drive system of the dynamic chair of the present invention.
Figure 6A:
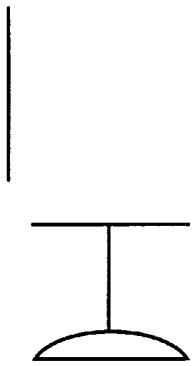
FIGS. 6A and 6B illustrate a profile view and elevation view, respectively, of a position of a chair that corresponds with a level point on the plot of FIG. 1.
Figure 6B:
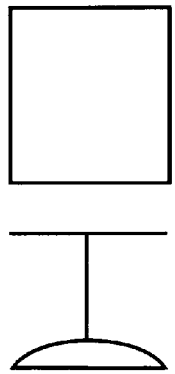
Figure 7:
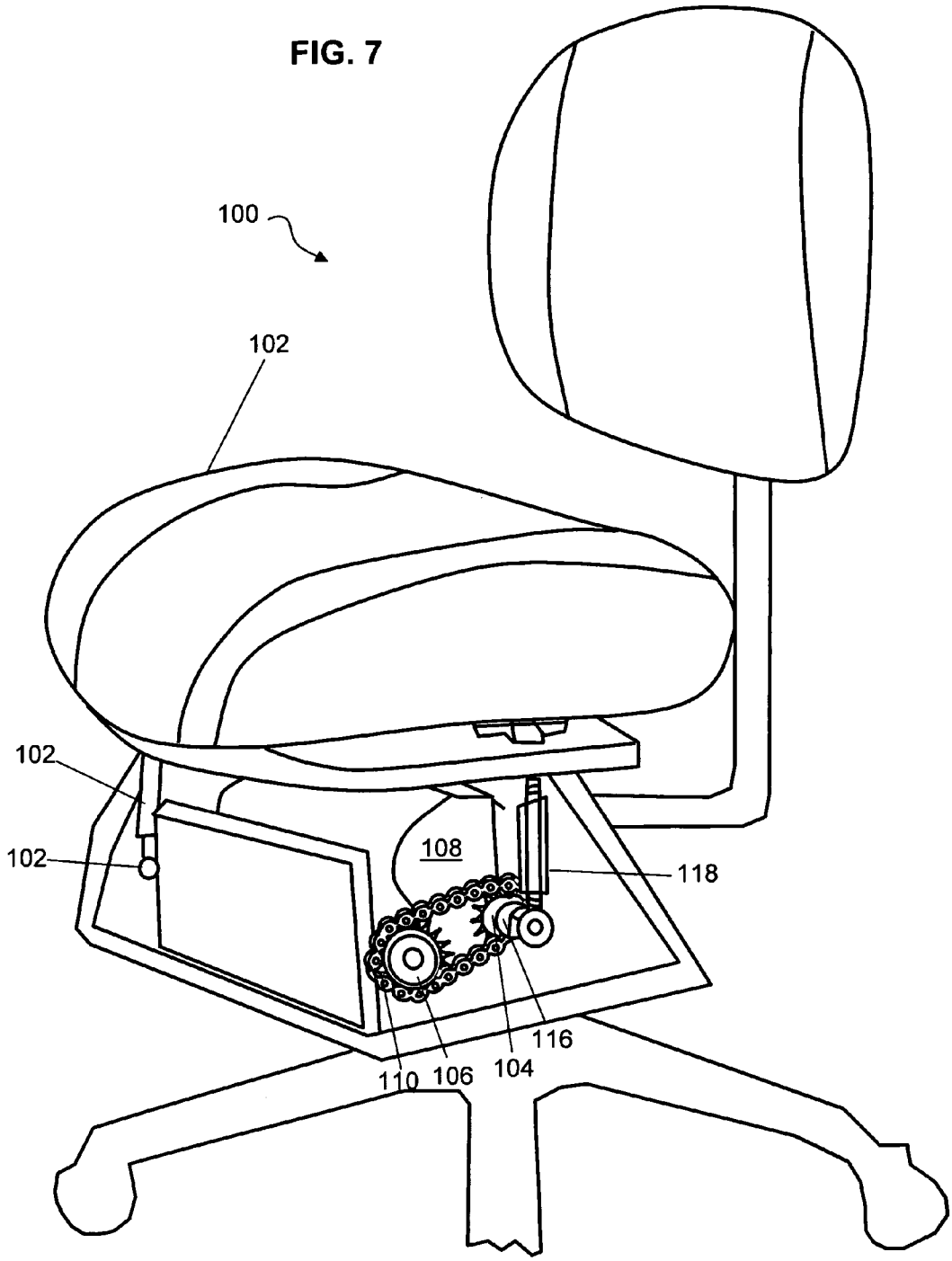
FIG. 7 illustrates the dynamic chair of the present invention.

Directing attention to FIG. 7, the present invention provides chair 100 having a seat 102 that is manipulated through a large number of different angular motion paths. The seat moves in a synchronized motion path employing two or more degrees of freedom, depending on the embodiment. This motion system consists of two drive wheels 104, 106. Drive wheel 104 is driven from gear motor 108. Drive wheel 106 is driven by chain 110 connected to drive wheel 104 (FIG. 9). The ratio between the diameters of drive wheels 104, 106 determines the motion paths for seat 102.

If the diameters of drive wheels 104, 106 are equal, a circular tilting pattern will occur and the seat will never be in a horizontal position. Thus, in a preferred embodiment, drive wheels 104, 106 are of different diameters to generate a periodic path of varying ellipsoidal tilting motions. The number of tilting motion iterations per repeating pattern is determined by the ratio between drive wheels 104, 106. If the ratio is not equal the seat of the chair will be horizontal or nearly horizontal two times during each period. In a preferred embodiment, the present invention utilizes a ratio of 7:6 between drive wheels 104, 106. A useful range of ratios is about 1:20 to about 20:1, excluding the ratio of 1:1. A ratio close to 1:1 will make the number of roll to pitch tilts per repeating motion paths more equal.

Figure 8:
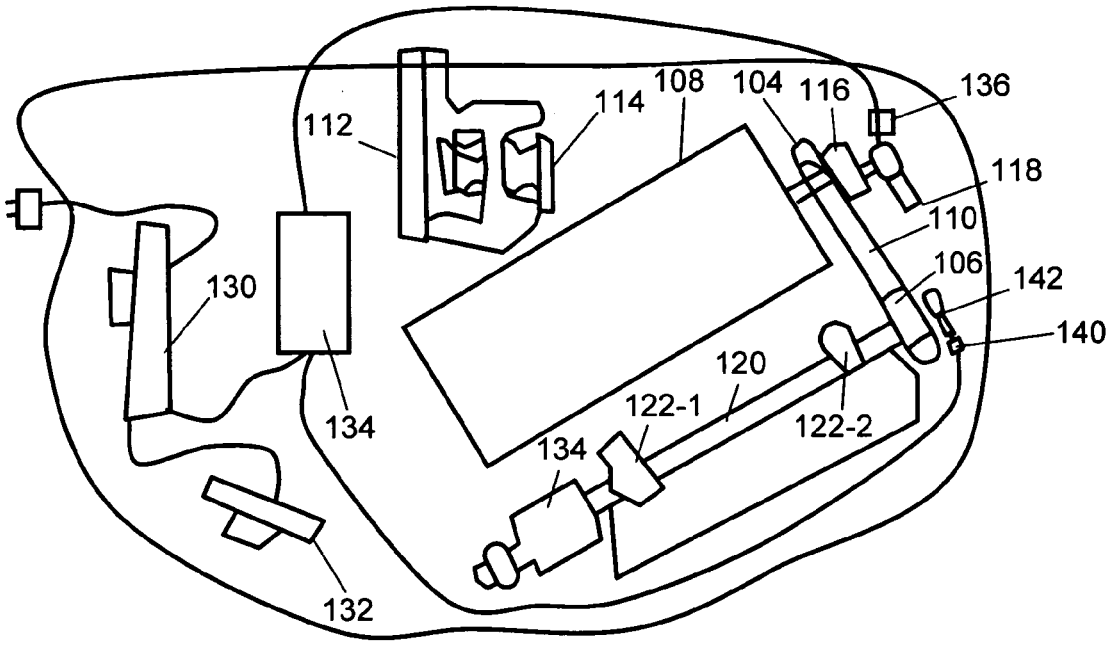
FIG. 8 illustrates a plan view of elements used in an embodiment of the present invention.
Figure 10:
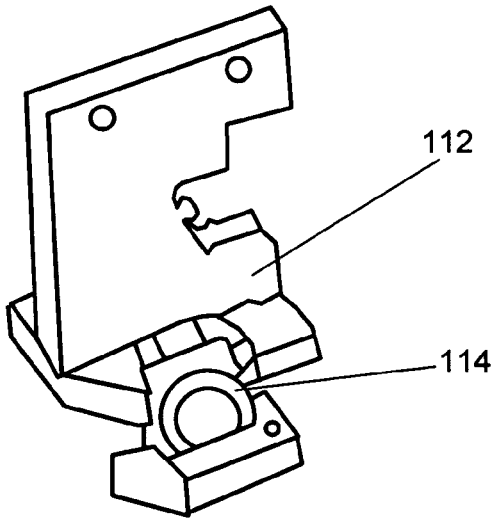
FIG. 10 illustrates the chair support and universal joint used in the dynamic chair of the present invention.

Directing attention to FIG. 8, in an embodiment, seat 102 supported by support 112 connected to universal joint 114 (FIG. 10). Universal joint 114 allows seat 102 to pivot about a central point. Eccentric member 116 is connected to drive wheel 104 to provide an off-center connection point for linkage 118 that is connected between eccentric member 116 and a side mounting point of seat 102.

The front of seat 102 is driven by crankshaft 120 that is supported by idler bearings 122. At the end of crankshaft 120, eccentric member 124 provides an off-center connection for linkage 126. Linkage 126 is connected between eccentric member 124 and a mounting point beneath the front of seat 102. Both eccentric member 116 and eccentric member 124 may have a plurality of off-center mounting points located at different radii from the center of rotation, to provide adjustments to the magnitude of vertical change to seat 102 by linkages 118, 126, respectively.

While in a preferred embodiment, drive wheels 104, 106 are sprockets that are connected by a roller chain, in alternative embodiments, drive wheels 104, 106 can be pulleys and chain 110 can be substituted with a drive belt connecting drive wheels 104, 106. In another embodiment, drive wheels 104, 106 can be gears that interface directly with each other, or through intermediate gearing. In yet another embodiment, drive wheel 104 and crankshaft 120 can be independently powered by separate drive motors that turn drive wheel 104 and crankshaft 120 at respective rotational speeds to achieve the same motion paths generated by drive wheels 104, 106 having the range of diameter ratios between about 1:20 through 20:1.

Figure 1:
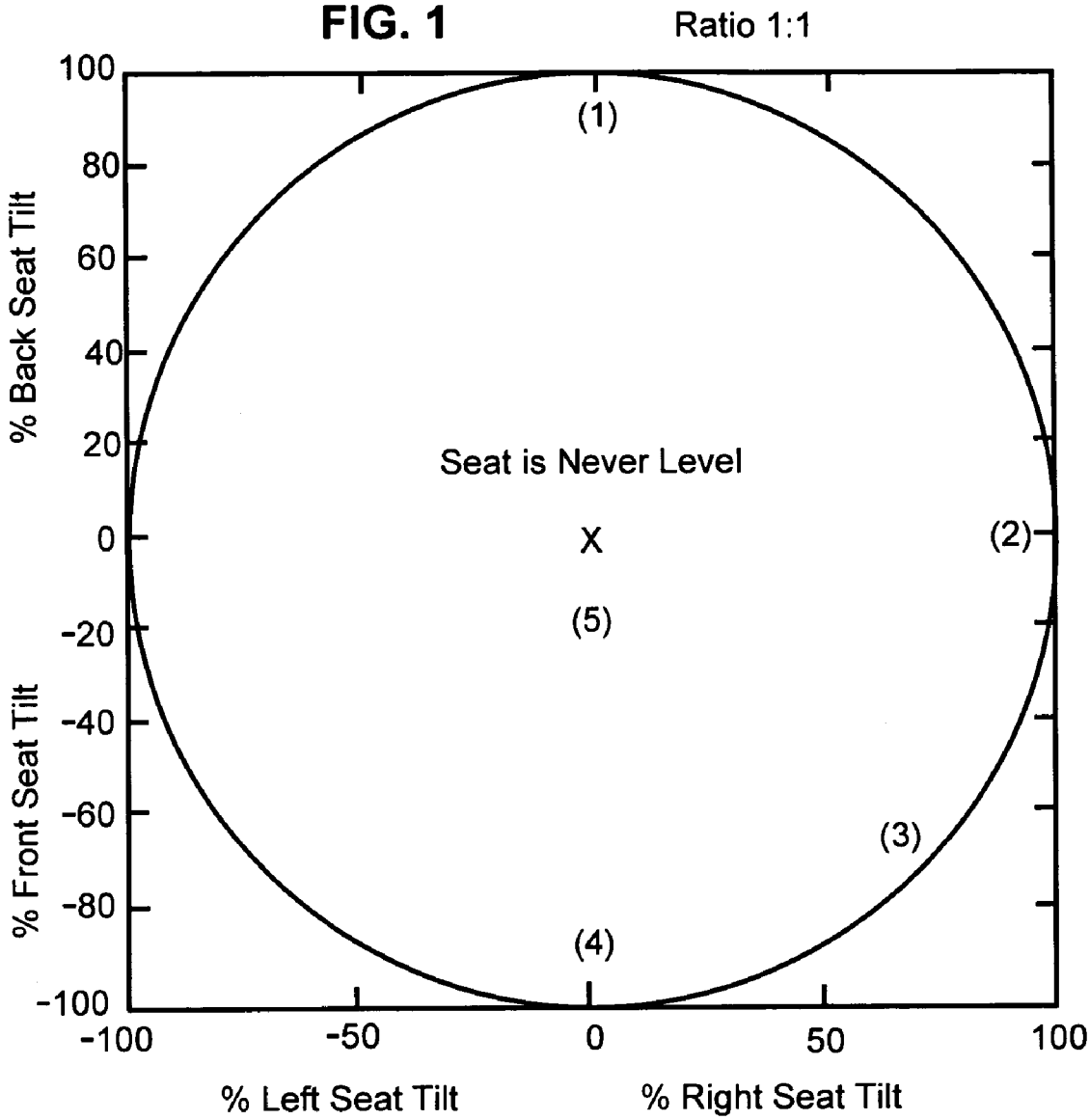
FIG. 1 illustrates a graphical plot of a range of motion in an existing chair.
Figure 2A:
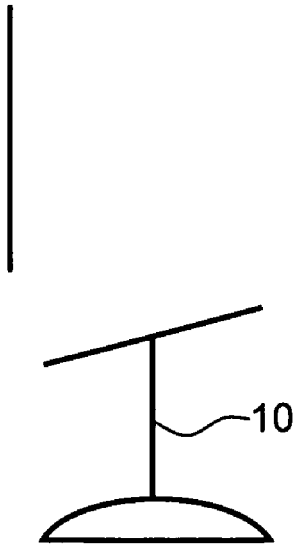
FIG. 2A Prior Art
FIGS. 2A and 2B illustrate a profile view and elevation view, respectively, of a position of an existing chair that corresponds with a point on the plot of FIG. 1.
Figure 2B:
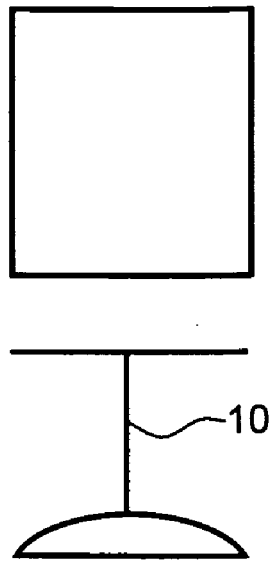
FIG. 2B Prior Art
Figure 3A:
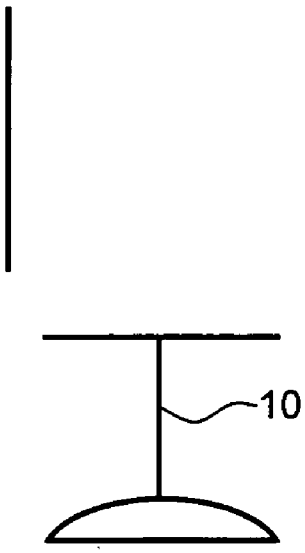
FIG. 3A Prior Art
FIGS. 3A and 3B illustrate a position of an existing chair that corresponds with a point on the plot of FIG. 1.
Figure 3B:
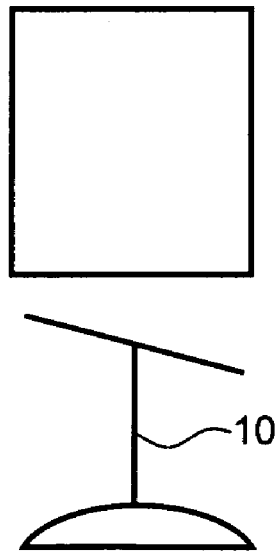
FIG. 3B Prior Art
Figure 4A:
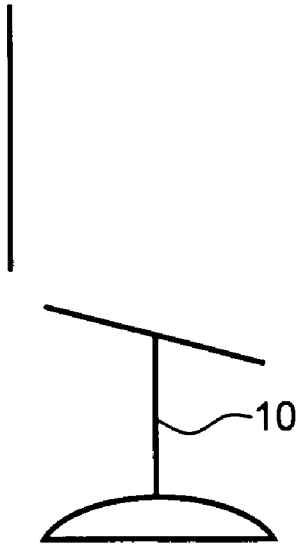
FIG. 4A Prior Art
FIGS. 4A and 4B illustrate a profile view and elevation view, respectively, of a position of an existing chair that corresponds with a point on the plot of FIG. 1.
Figure 4B:
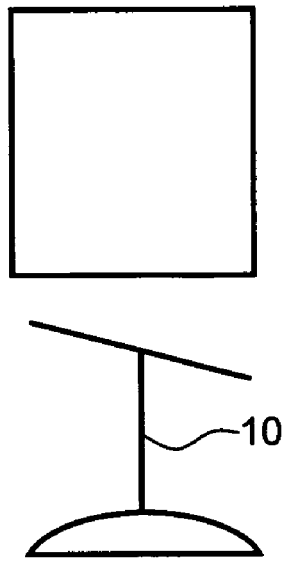
FIG. 4B Prior Art
Figure 5A:
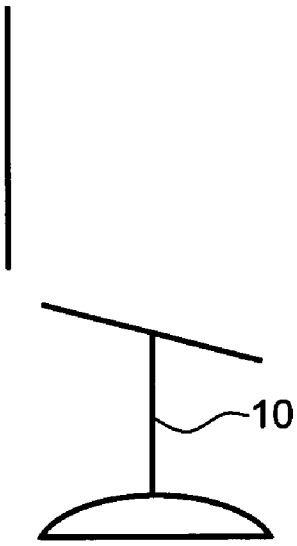
FIG. 5A Prior Art
FIGS. 5A and 5B illustrate a profile view and elevation view, respectively, of a position of an existing chair that corresponds with a point on the plot of FIG. 1.
Figure 5B:
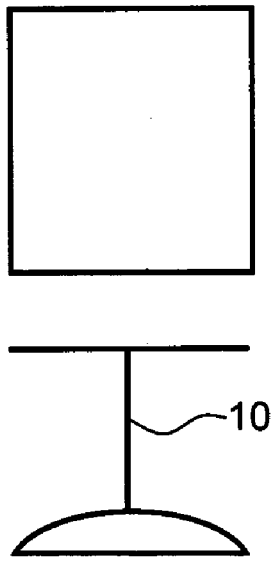
FIG. 5B Prior Art
Figure 11:
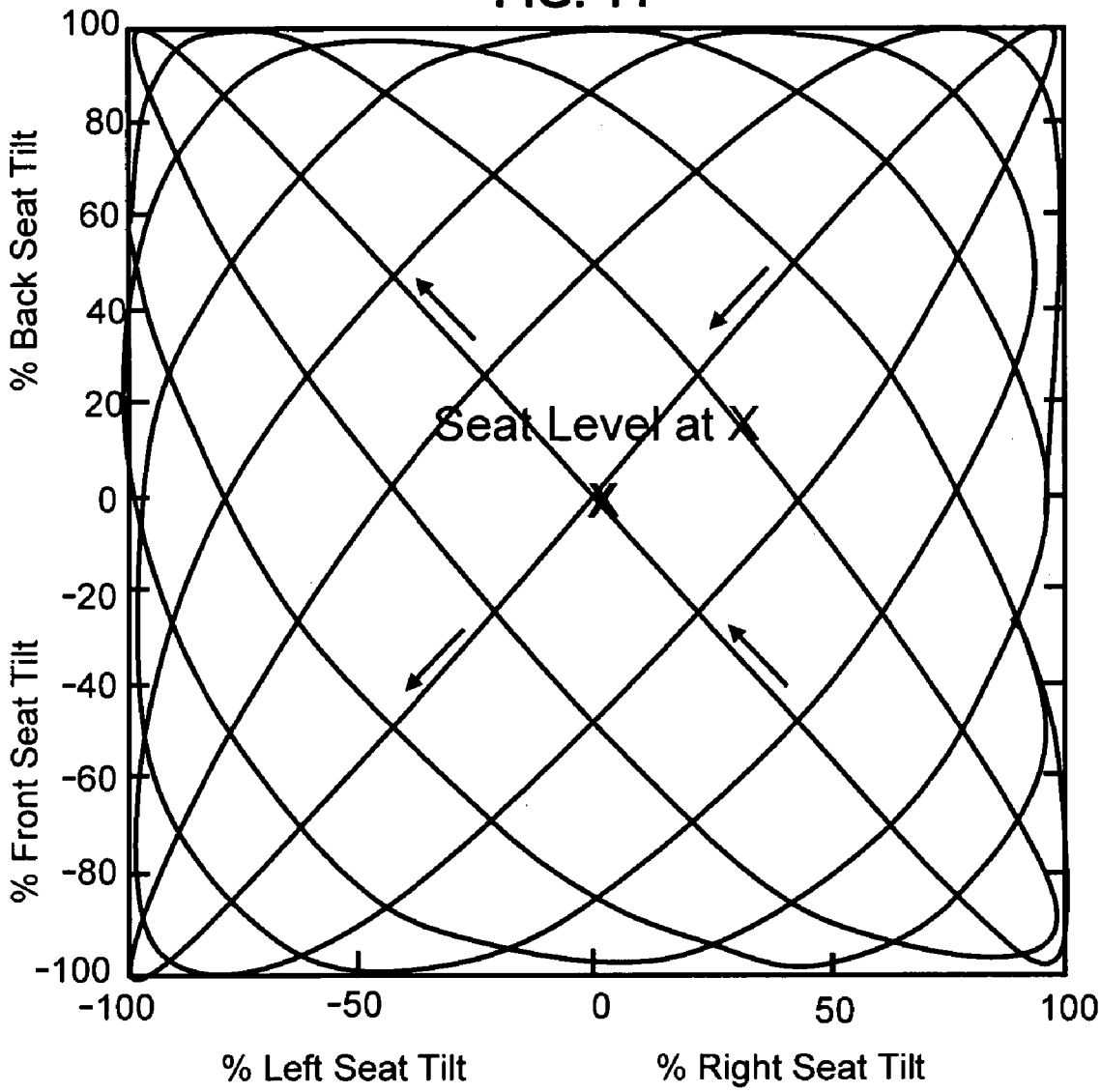
FIG. 11 illustrates a motion path of six cycles of the dynamic chair of the present invention when configured with drive wheels having a 7:6 ratio.
Figure 12:
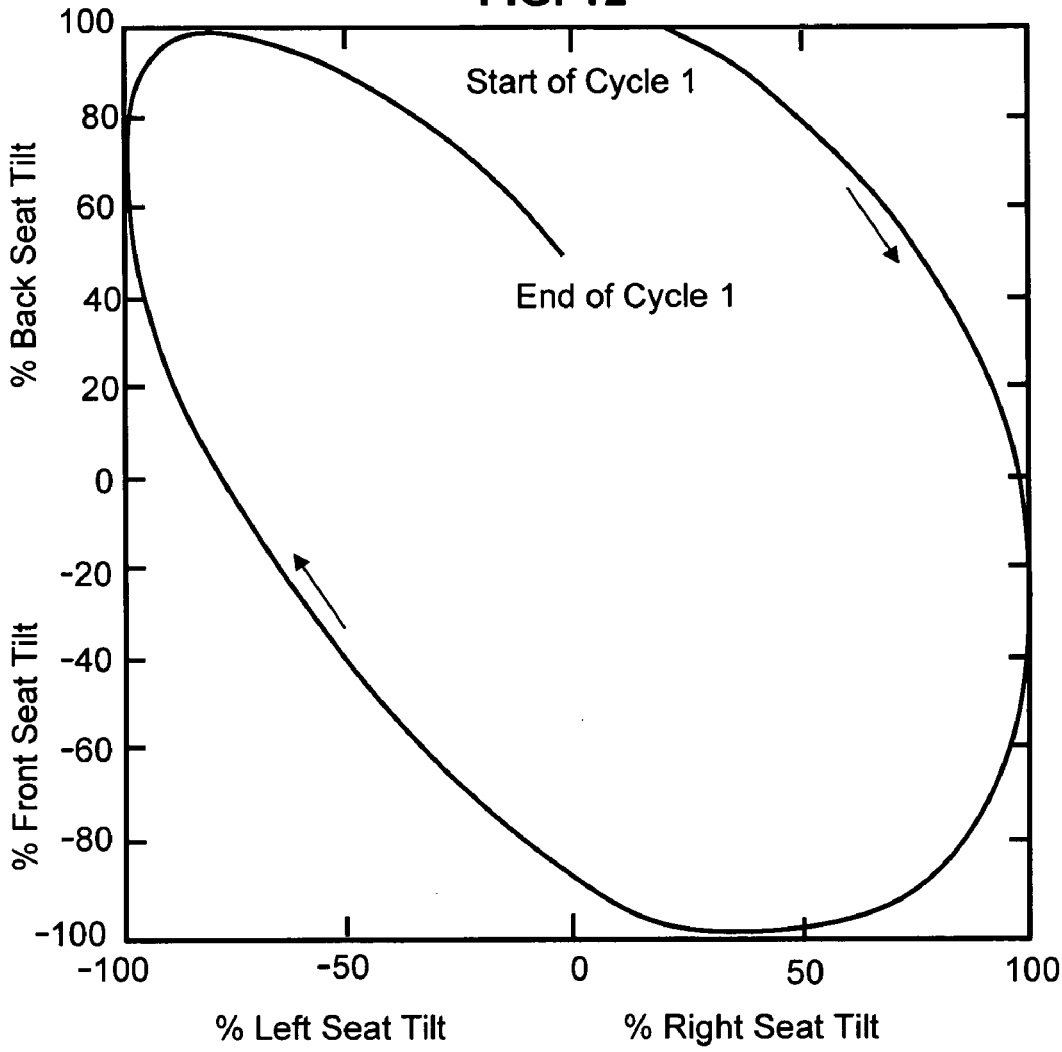
FIG. 12 illustrates a motion path of the first of six cycles of the dynamic chair configured in accordance with FIG. 11.
Figure 13:
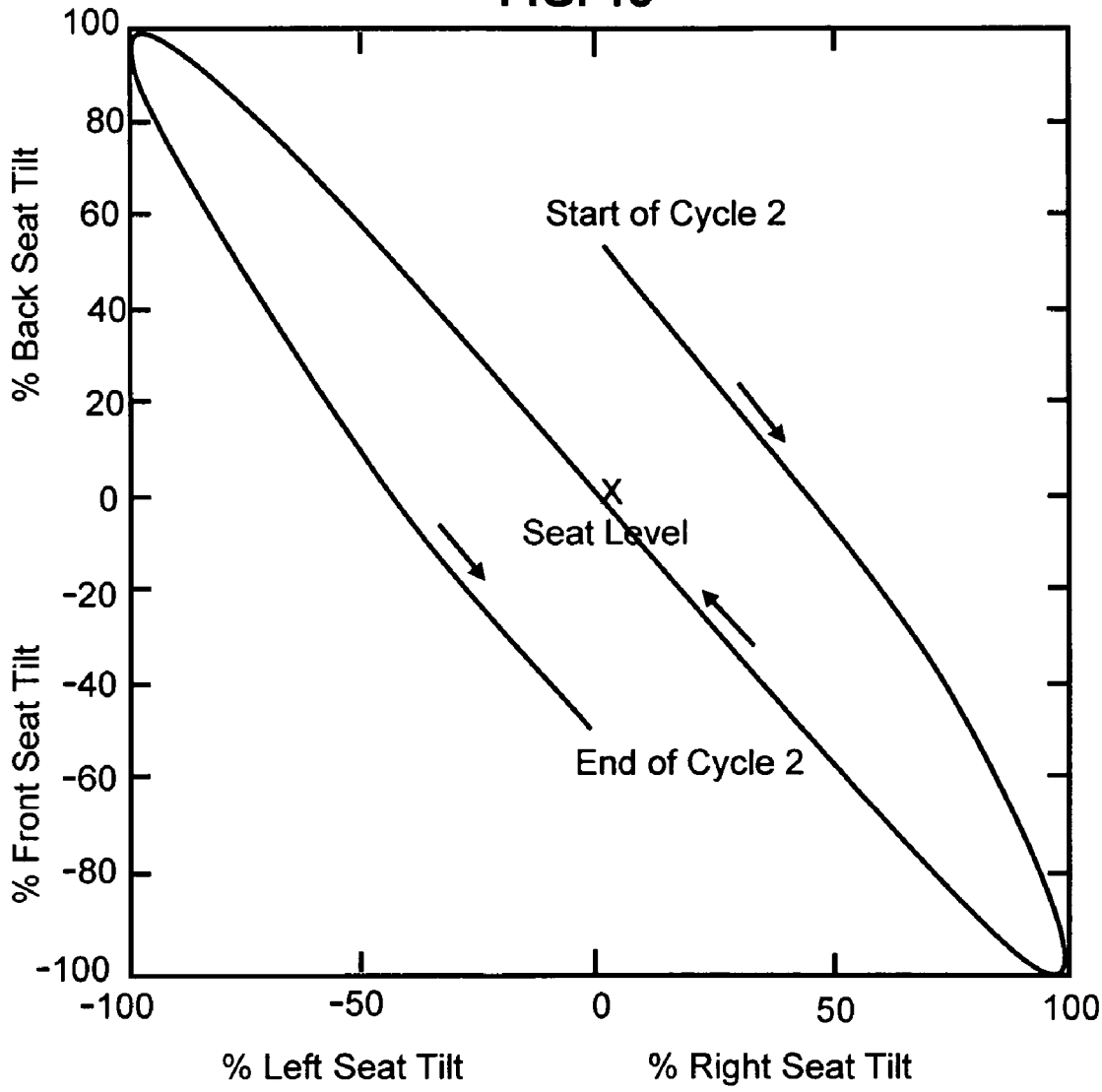
FIG. 13 illustrates a motion path of the second of six cycles of the dynamic chair configured in accordance with FIG. 11.
Figure 14:
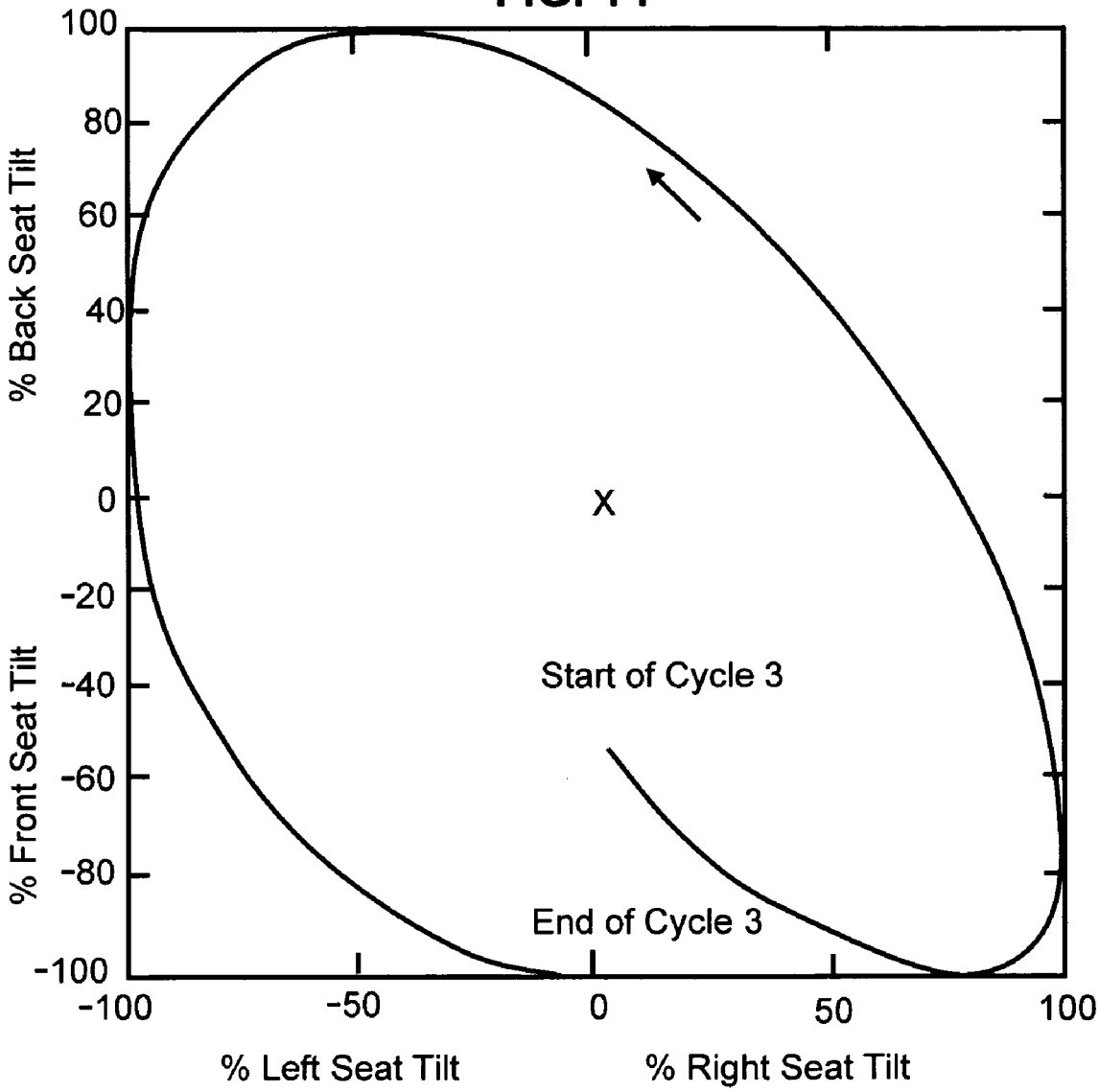
FIG. 14 illustrates a motion path of the third of six cycles of the dynamic chair configured in accordance with FIG. 11.
Figure 15:
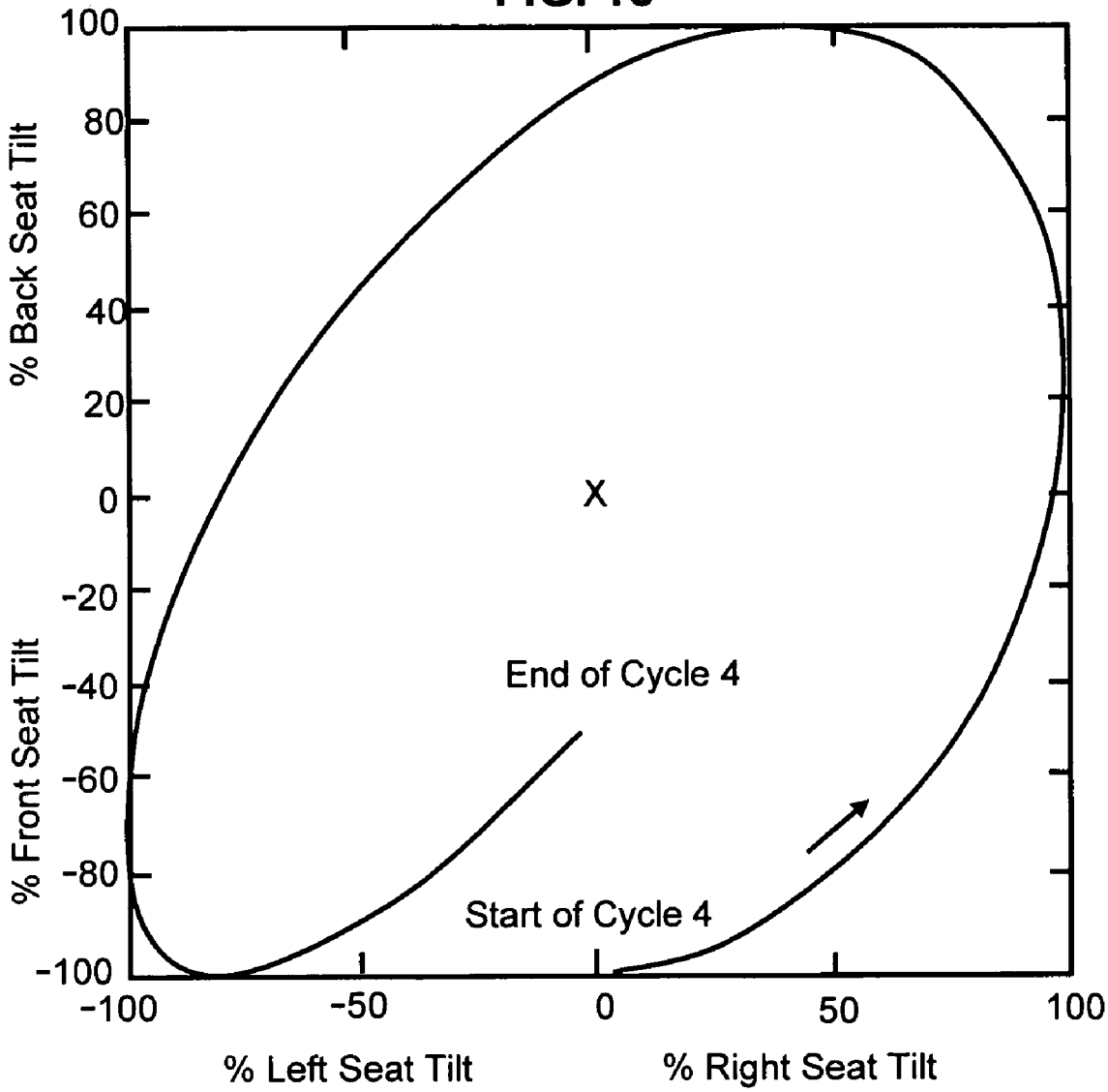
FIG. 15 illustrates a motion path of the fourth of six cycles of the dynamic chair configured in accordance with FIG. 11.
Figure 16:
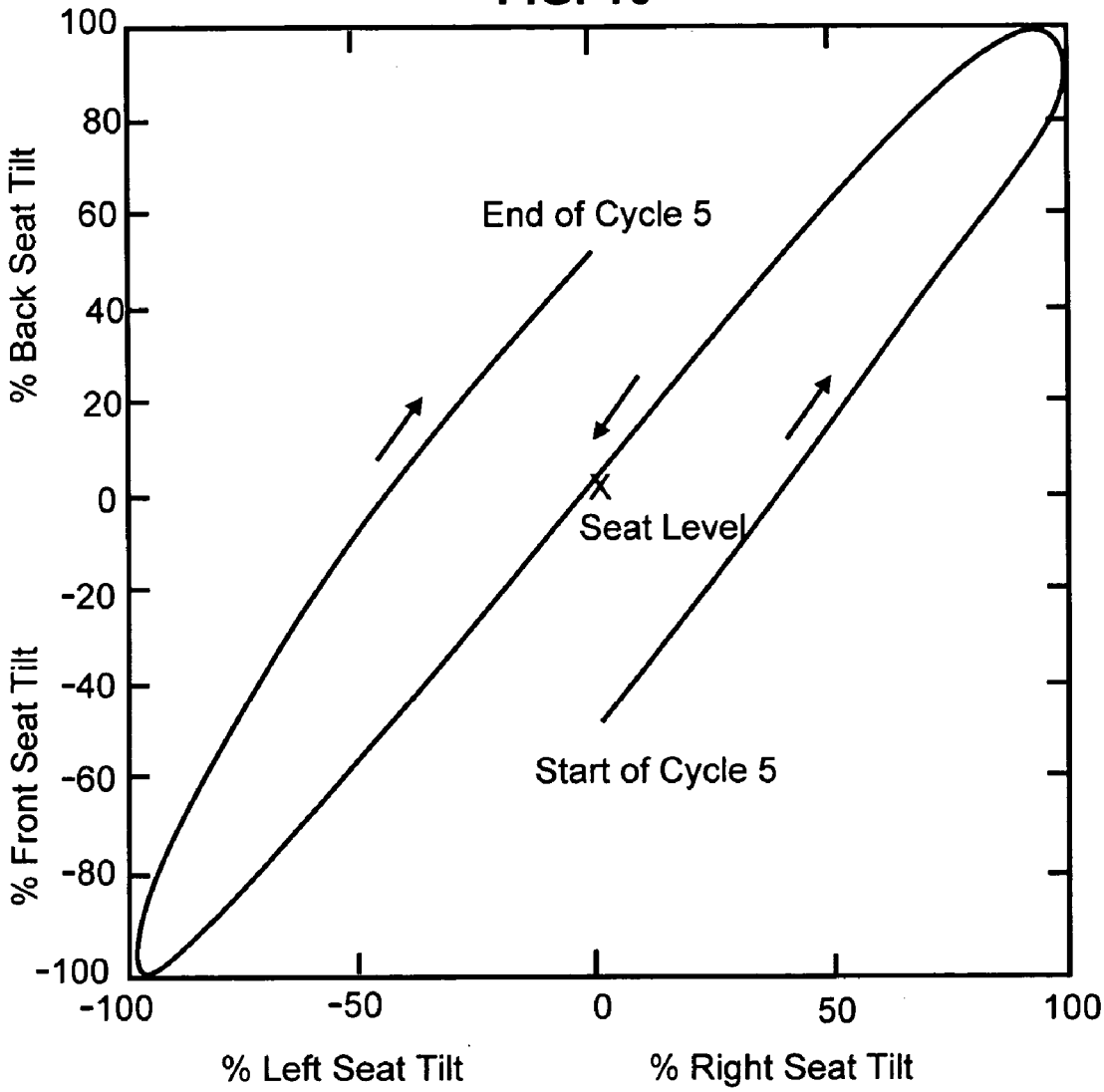
FIG. 16 illustrates a motion path of the fifth of six cycles of the dynamic chair configured in accordance with FIG. 11.
Figure 17:
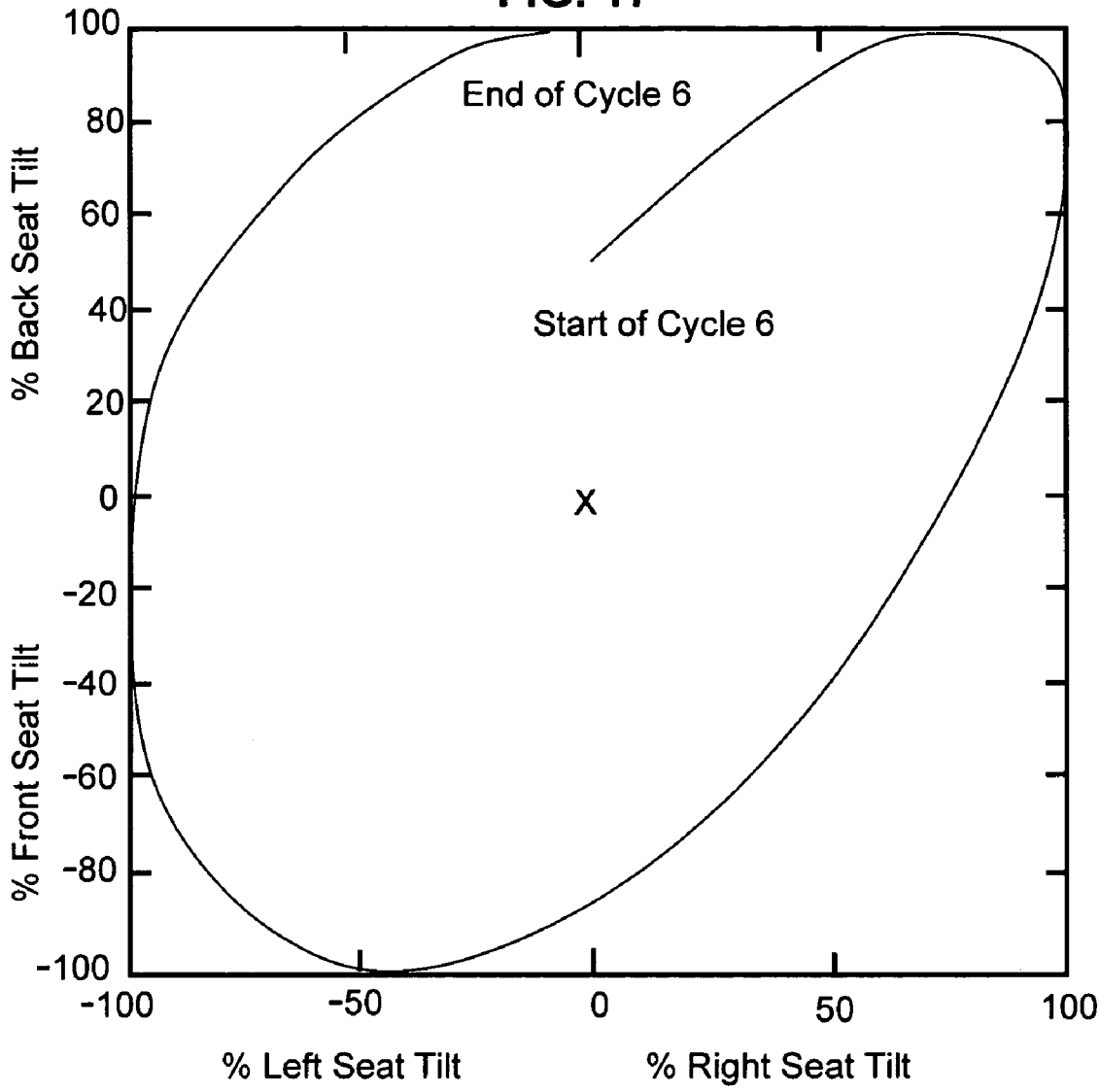
FIG. 17 illustrates a motion path of the sixth of six cycles of the dynamic chair configured in accordance with FIG. 11.
Figure 18:
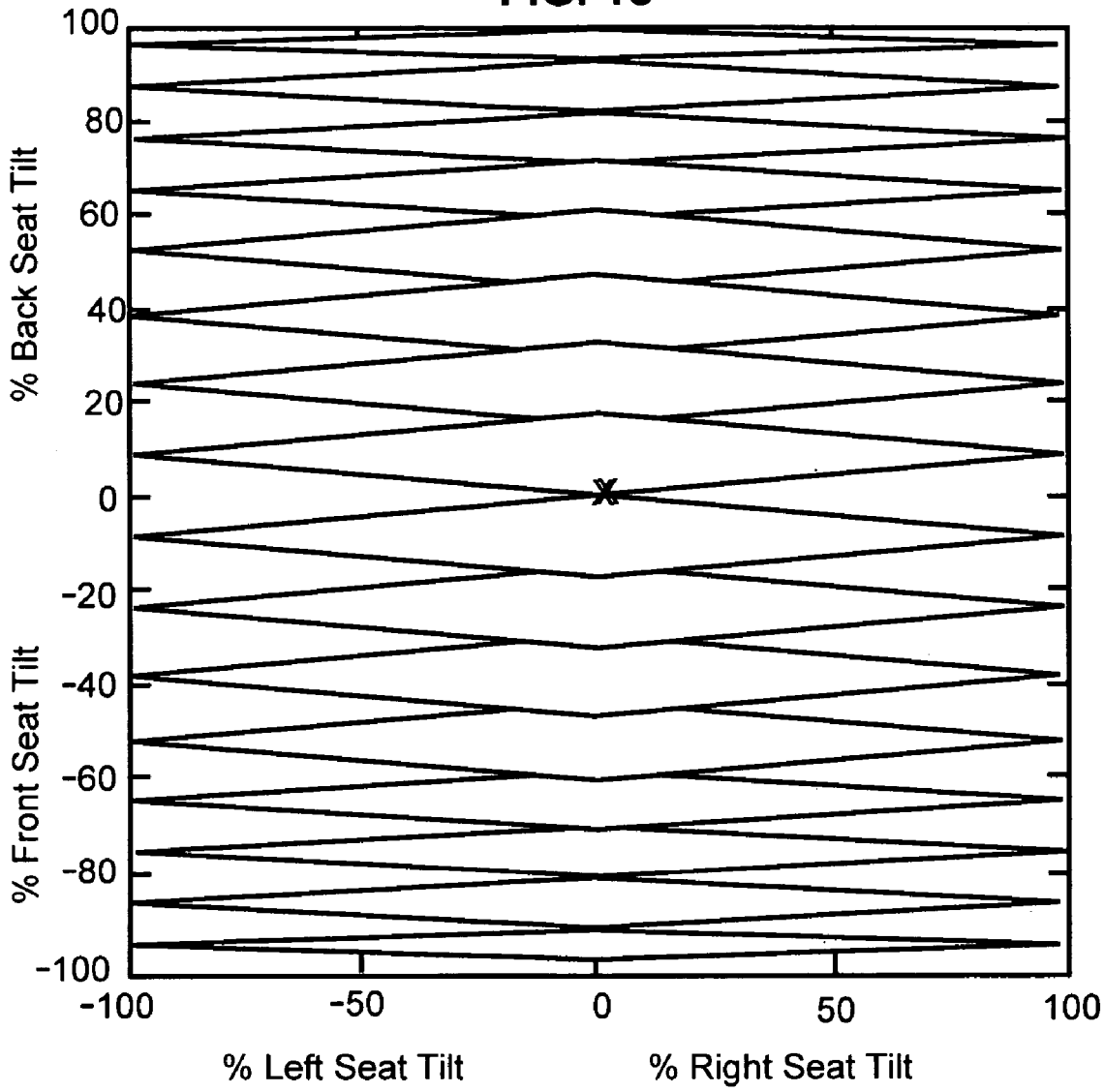
FIG. 18 illustrates a motion path of 20 cycles of the dynamic chair of the present invention when configured with drive wheels having a 1:20 ratio.
Figure 19:
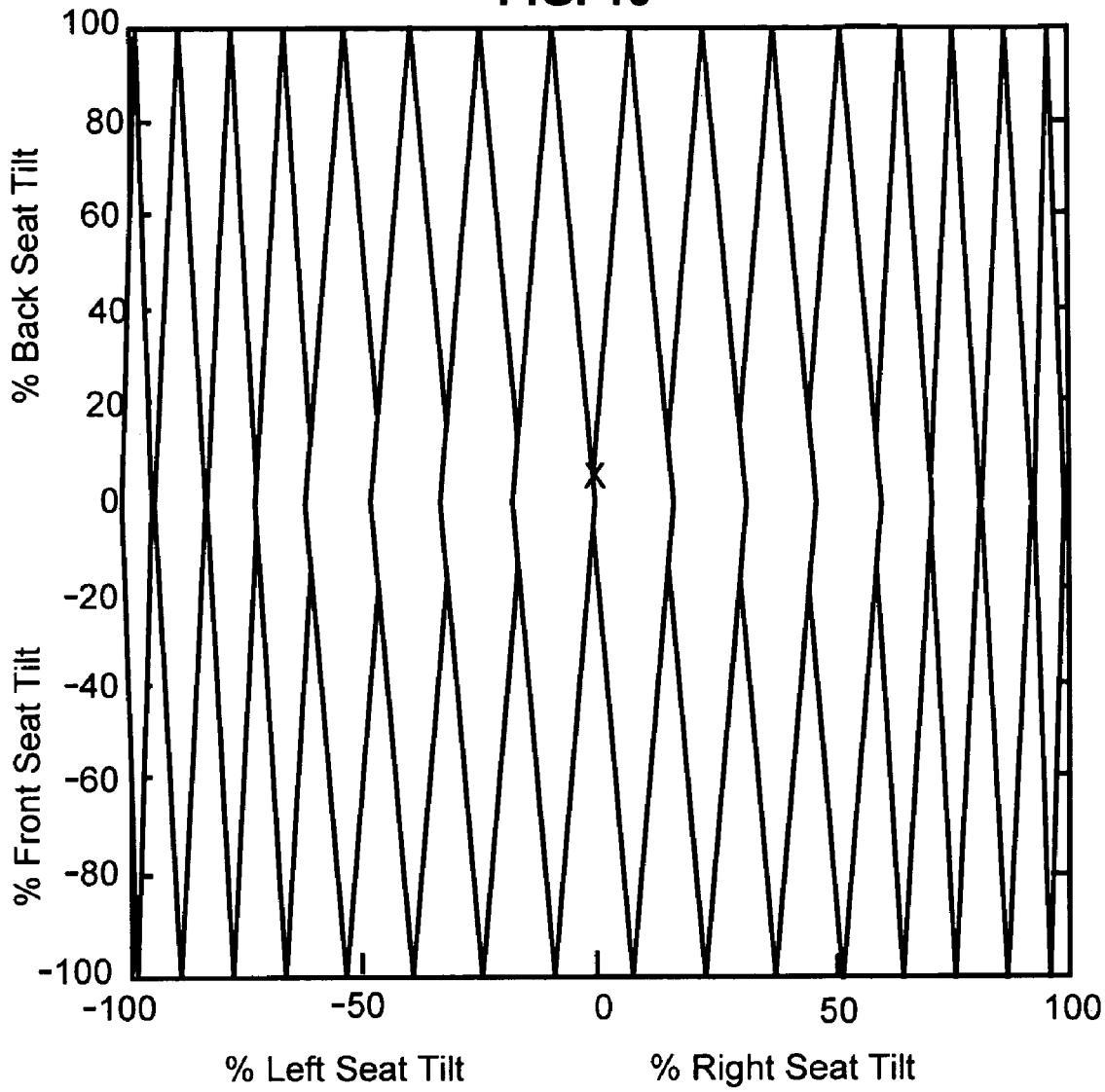
FIG. 19 illustrates a motion path of 20 cycles of the dynamic chair of the present invention when configured with drive wheels having a 20:1 ratio.

The motion paths generated in the present invention cause seat 102 to tilt between a level, horizontal position and various tilted positions. The deterministic and repeatable complex angular motion path generated by the present invention allows seat 102 to tilt in a much larger range of positions than the circular path methods of the prior art. This complex angular path is illustrated in a graphical plot in FIG. 11. As shown in FIG. 11, seat 102 is moved in accordance with a Lissajou pattern. To generate the path in FIG. 11 a drive wheel ratio of 7:6 was used. This path consists of six cycles. A more detailed graphical representation of each cycle of this path is shown in FIG. 12 through FIG. 17. Directing attention to FIG. 11(5) the X indicates the location where seat 102 is level. With a ratio of 7:6 the seat becomes level twice during the six angular path cycles this ratio generates. This ratio metric angular motion path has the ability to reverse direction without reversing the direction of the motor. In FIG. 13(2) the direction of the angular motion changes from clockwise to counter clockwise and reverses again to clockwise in FIG. 16(3). Comparing FIG. 11 to the angular path of the prior art in FIG. 1 it should be obvious the angular path of this invention provides a much larger range of angular motions than the prior art circular motion method. While ratio of 7:6 was used in this invention, a much larger set of other ratios will generate many desirable angular motion paths. Different ratio metric ratios will produce different repeating angular paths and a different number of cycles before the pattern repeats.

In an embodiment, motor 108 (and thus the motion of seat 102) is controlled by speed control mechanism 130, which is adjustable by speed adjustment mechanism 132. In an embodiment, motor timer 134 is included to also provide periods where motion of seat 102 is temporarily suspended. This allows the motion to be stopped when seat 102 is level and thus constant postural changes are not required.

Returning to FIG. 9, in an embodiment, the present invention detects when seat 102 is level with respect to pitch and roll. To detect when seat 102 is level, two horizontal seat sensors are disposed proximate to drive wheels 104, 106. Sensor 136 determines when seat 102 is horizontal with respect to left/right tilt. In an embodiment, sensor 136 utilizes a stationary, mechanically activated electrical switch such as a limit switch. Sensor 136 is triggered when a lobe on cam 138 makes contact with sensor 136. Cam 138 is attached to protrude radially from drive wheel 104 and revolves as drive wheel 104 rotates. The lobe on cam 138 is positioned to contact sensor 136 when seat 102 is horizontal with respect to left/right tilt. A similar sensor and cam are disposed proximate to drive wheel 106 to determine when seat 102 is level with respect to front/back tilt. In an embodiment, sensor 140 utilizes a stationary, mechanically activated electrical switch such as a limit switch. Sensor 140 is triggered when a lobe on cam 142 makes contact with sensor 140. Cam 142 is attached to protrude radially from drive wheel 106 and revolves as drive wheel 106 rotates. The lobe on cam 142 is positioned to contact sensor 140 when seat 102 is horizontal with respect to front/back tilt. When both sensors 136, 140 are activated, seat 102 is level with respect to pitch and roll. In an embodiment, when motor timer 134 is in the SEAT ON mode, motor 108 is powered on and drives drive wheels 104, 106. When motor timer 134 is in the SEAT OFF mode and horizontal seat sensors 136 and 140 are triggered, motor 108 is powered off. In an embodiment, motor timer 134 contains logic that allow an adjustable interval during which sensors 136 and 140 are serially activated and motor 108 is powered off when seat 102 is in a position that is close to level with respect to pitch and roll but contains a slight tilt in either pitch, roll, or both. This is especially useful for accommodating individual needs such as an injury where the seated person finds comfort in a slightly off-level position.

Since the motion of seat 102 can be stopped, chair 100 may be used as a regular level chair. The motion of seat 102 can be automatically stopped for periodic level seat time out periods.

While the preferred embodiment of the present invention uses a drive wheel ratio of 7:6 (Gearing 14:12), reversing this ratio to 6:7 will yield similar results. While chair 100 is illustrated herein as a conventional chair, chair 100 is also particularly useful when incorporated into the design of a wheelchair, and is also useful in vehicles such as automobiles, airplanes, or any other application where a person remains seated for prolonged periods of time.

While in the preferred embodiment linkages 118 and 126 are attached to the bottom side of the seat and the bottom front of the seat respectively, in an alternative embodiment, linkages 118, 126 are connected directly to support 112 rather than to seat 102. In this alternative embodiment, linkages 118 and 126 are still orthogonal with respect to each other. In this alternative embodiment, the seat motion is the same as in the preferred embodiment. In this alternative embodiment, motor 108, sprockets 104, 106, eccentric 116 and chain 110 are rotated 90 degrees to assume a horizontal orientation. Eccentric 124 is attached directly to drive wheel 106. Crankshaft 120 and bearings 122-1, 122-2 are replaced by an idler bearing.

While various embodiments of the dynamic chair of the present invention have been described and illustrated in detail, it is to be understood that many changes to the embodiments can be realized without departing from the spirit of the invention.

What is claimed is:

1. A dynamic chair providing automatic motion in a seat, the chair comprising:

a base;

a seat having a bottom, the seat bottom having a first seat bottom mounting point and a second seat bottom mounting point;

a support means disposed between the base and the seat bottom;

a drive motor;

a first drive wheel driven in a rotational manner by the drive motor, the first drive wheel having a first mounting point offset from a first distance from the center of the first drive wheel;

a first control arm providing a first rotational degree of freedom of movement to the seat about a first axis of rotation, the first control arm attached between the first offset mounting point and the first seat bottom mounting point;

a second drive wheel driven in a rotational manner by the first drive wheel;

a crankshaft having a first crankshaft end and a second crankshaft end, the first crankshaft end connected to the second drive wheel and rotatably driven by the second drive wheel, the second crankshaft end having an eccentric providing a second offset mounting point offset from a second distance from the center of the second crankshaft end, the second distance not equal to the first distance;

a second control arm providing a second rotational degree of freedom of movement to the seat about a second axis of rotation, the second axis of rotation perpendicular to the first axis of rotation, the second control arm attached between the second offset mounting point and the second seat bottom mounting point;

wherein, during rotation of the first drive wheel and the second drive wheel, the seat bottom rotates about the first axis of rotation and the second axis of rotation simultaneously, thus producing a substantially ellipsoidal pattern of movement in the seat bottom.

* * * * *